US006082840A

United States Patent [19]

Chau et al.

[11] Patent Number: 6,082,840

[45] Date of Patent: Jul. 4, 2000

[54] FREESTANDING FURNITURE SYSTEM

[75] Inventors: Theodore Q. Chau, Grand Rapids, Mich.; Brian J. Kane, San Francisco, Calif.; John L. McCrackin, Grand Rapids, Mich.

[73] Assignee: Steelcase Development Inc., Grand Rapids, Mich.

[21] Appl. No.: 09/060,622

[22] Filed: Apr. 15, 1998

[51] Int. Cl.[7] ..... A47B 81/00

[52] U.S. Cl. ..... 312/223.6; 312/223.3; 108/50.02

[58] Field of Search ..... 108/50.01, 50.02, 108/155, 156; 312/223.6, 223.3, 195, 194, 265.1, 265.2, 265.3, 263; 403/246, 245; 52/220.7; 248/74.2

[56] References Cited

U.S. PATENT DOCUMENTS

| | | | |
|---|---|---|---|
| D. 182,964 | 6/1958 | Jakobsen et al. . | |
| D. 371,703 | 7/1996 | Muller-Deisig et al. . | |
| 1,955,147 | 4/1934 | Remington . | |
| 2,499,668 | 3/1950 | Morgan et al. . | |
| 3,635,174 | 1/1972 | Ball et al. . | |
| 3,856,371 | 12/1974 | Forsyth | 312/195 |
| 3,981,251 | 9/1976 | Damberg | 108/156 X |
| 3,992,067 | 11/1976 | Kane . | |
| 4,163,592 | 8/1979 | Nelson . | |
| 4,287,837 | 9/1981 | Bayles | 312/195 X |
| 4,637,324 | 1/1987 | Janson . | |
| 4,685,255 | 8/1987 | Kelley . | |
| 4,821,477 | 4/1989 | Rydqvist . | |
| 4,827,850 | 5/1989 | Diffrient . | |
| 4,917,340 | 4/1990 | Juemann et al. | 248/74.2 |
| 5,024,167 | 6/1991 | Hayward | 108/50.02 |
| 5,172,529 | 12/1992 | Van De Riet . | |
| 5,272,988 | 12/1993 | Kelley et al. . | |
| 5,277,131 | 1/1994 | Fortsch . | |
| 5,428,928 | 7/1995 | Hellwig et al. . | |
| 5,429,431 | 7/1995 | Olson et al. | 312/223.6 |
| 5,473,994 | 12/1995 | Foley et al. . | |
| 5,606,920 | 3/1997 | Meyer et al. . | |
| 5,638,759 | 6/1997 | Klugkist . | |
| 5,640,912 | 6/1997 | Diffrient . | |
| 5,673,632 | 10/1997 | Sykes . | |
| 5,715,760 | 2/1998 | Frascaroli et al. . | |
| 5,715,761 | 2/1998 | Frattini | 312/223.6 X |
| 5,718,492 | 2/1998 | Ellison . | |
| 5,752,449 | 5/1998 | Simon et al. | 108/50.02 |

*Primary Examiner*—Anthony Knight
*Assistant Examiner*—Karlena D. Schwing
*Attorney, Agent, or Firm*—Price, Heneveld, Cooper, DeWitt & Litton

[57] ABSTRACT

A worksurface unit includes a worksurface defining a lower surface, a front edge shaped to be positioned adjacent a seated user, and a rear edge disposed opposite said front edge. The rear edge includes a substantially straight portion and a concave cut-out portion. The worksurface includes at least two legs, each having an upper end operably connected with the worksurface adjacent the rear edge, and a lower end shaped to support the worksurface on a floor. A panel is connected with and extends between the legs, and has an upper edge spaced-apart from the lower surface of the worksurface to define a passageway. The panel upper edge is sloped downwardly towards the front edge of the worksurface such that utility lines can be routed through the cut-out portion of the rear edge, through the passageway and over the sloped upper edge of the panel.

43 Claims, 5 Drawing Sheets

FREESTANDING FURNITURE SYSTEM

BACKGROUND OF THE INVENTION

The present invention relates to a freestanding furniture system for offices and the like, and in particular to a freestanding furniture unit with wire management capabilities.

Modern offices are becoming increasingly complicated and sophisticated due largely to the ever increasing needs of the users for improved utility support at each workstation, such as communications, computers and other types of data processors, electronic displays, etc. For example, modern offices for high "knowledge workers" such as engineers, accountants, stock brokers, computer programmers, etc., are typically provided with multiple pieces of very specialized computer and communications equipment that are capable of processing information from numerous local and remote data sources to assist in solving complex problems. Such equipment has very stringent power and signal requirements, and must quickly and efficiently interface with related equipment at both adjacent and remote locations. One important consequence of the advent of sophisticated electronic offices is the increased need and desirability for distributing utilities such as data and power lines throughout the various offices in a manner which can be readily reconfigured.

One arrangement commonly used for furnishing open plans includes movable partition panels that are detachably interconnected to partition off the open spaces into individual workstations and/or offices. Another arrangement for dividing and/or partitioning open plans includes modular furniture arrangements, and which a plurality of differently shaped, freestanding furniture units are positioned in a side-by-side relationship, with upstanding privacy screens attached to at least some of the furniture units to create individual, distinct workstations and/or offices. In order to insure peak efficiency, the workstation must be equipped with the various state-of-the-art utilities and facilities discussed above.

In view of the increasing need to provide power and data utilities and the like to individual workstations, the management of such utilities at the individual workstations has become an important factor in furnishing modern office spaces.

SUMMARY OF THE INVENTION

One aspect of the present invention is to provide a freestanding worksurface unit for offices and the like. The worksurface unit includes a worksurface defining a lower surface, a front edge shaped to be positioned adjacent a seated user, and a rear edge disposed opposite said front edge. The rear edge includes a substantially straight portion and a concave cut-out portion. The worksurface includes at least two legs, each having an upper end operably connected with the worksurface adjacent the rear edge, and a lower end shaped to support the worksurface on a floor. A panel is connected with and extends between the legs, and has an upper edge spaced-apart from the lower surface of the worksurface to define a passageway. The panel upper edge is sloped downwardly towards the front edge of the worksurface such that utility lines can be routed through the cut-out portion of the rear edge, through the passageway and over the sloped upper edge of the panel.

Another aspect of the present invention is a freestanding worksurface unit for offices and the like, including a worksurface defining a rear edge. The worksurface unit includes at least two legs, each having an upper end secured to the worksurface adjacent the rear edge, and a lower end shaped to support the worksurface on a floor. The worksurface unit also includes upper and lower panels, with the upper panel juxtaposed above the lower panel. Each panel extends between the legs and defines opposite side edges that are removably connected to the legs. Each panel defines a lower edge having a raceway extending therealong for routing utility lines.

Yet another aspect of the present invention is a freestanding worksurface unit for offices and the like, including a worksurface defining a rear edge. The worksurface unit includes at least two legs, each having an upper end secured to the worksurface adjacent the rear edge. A panel extends between the legs and defines opposite side edges adjacent the legs. The panel includes an opening adjacent each side edge. At least one bracket has a base portion connected to a selected one of the legs, and a tab extending from the base in a first direction. The tab defines opposing slots, a first one of the slots opening upwardly and engaging a first opening in the panel. A second one of the slots opens downwardly, such that the bracket can be mounted to a selected one of the legs with the tab extending opposite the first direction such that the second slot opens upwardly to engage a second opening in the panel.

Yet another aspect of the present invention is a worksurface unit for offices and the like, including a worksurface defining a front edge and a rear edge. The worksurface unit includes at least two legs, each having an upper end secured to the worksurface, and a lower end shaped to support the worksurface on a floor. A wire retainer is connected to a selected one of the legs. The retainer has a C-shape with a base portion connected to a selected one of the legs, and a pair of flexible arms extending therefrom to releasably retain utility lines within the flexible arms along the leg.

Yet another aspect of the present invention is a wire manager for worksurfaces and the like, including a rear wall having opposite ends and defining an outer surface closely corresponding to a concave cut-out portion of an edge of a worksurface. A substantially straight front wall extends between the opposite ends of the rear wall to define with the rear wall a wire-receiving opening. The wire manager includes at least one wire-retaining prong extending from the rear wall into the opening to retain a free end of a wire above a worksurface.

Yet another aspect of the present invention is a kit for freestanding worksurface units including a worksurface defining a front edge shaped to be positioned adjacent a seated user, and a rear edge. At least two legs are adapted to be secured to the worksurface adjacent the rear edge. Each leg includes an upper connector and a lower connector. A panel defines opposite side edges, each side edge adapted to interconnect with the upper and lower connectors, thereby permitting the panel to be mounted in an upper position on the upper connectors, and a lower position on the lower connectors.

These and other advantages of the invention will be further understood and appreciated by those skilled in the art by reference to the following written specification, claims, and appended drawings.

DETAILED DESCRIPTION OF PREFERRED EMBODIMENT

Figure 1:
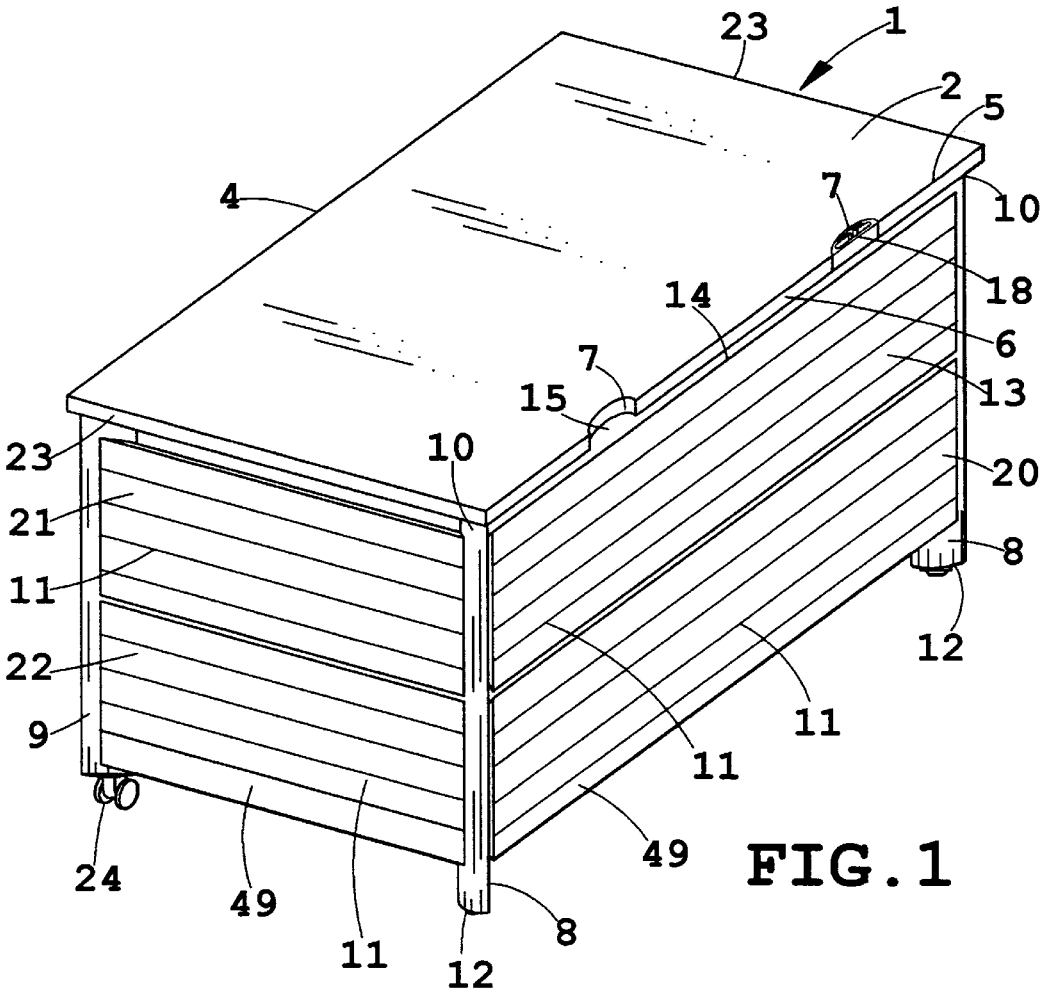
FIG. 1 is a perspective view of a freestanding worksurface unit for offices and the like embodying the present invention, including wire managers and modesty panels with provisions for wire management.

For purposes of description herein, the terms "upper," "lower," "right," "left," "rear," "front," "vertical," "horizontal, " and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
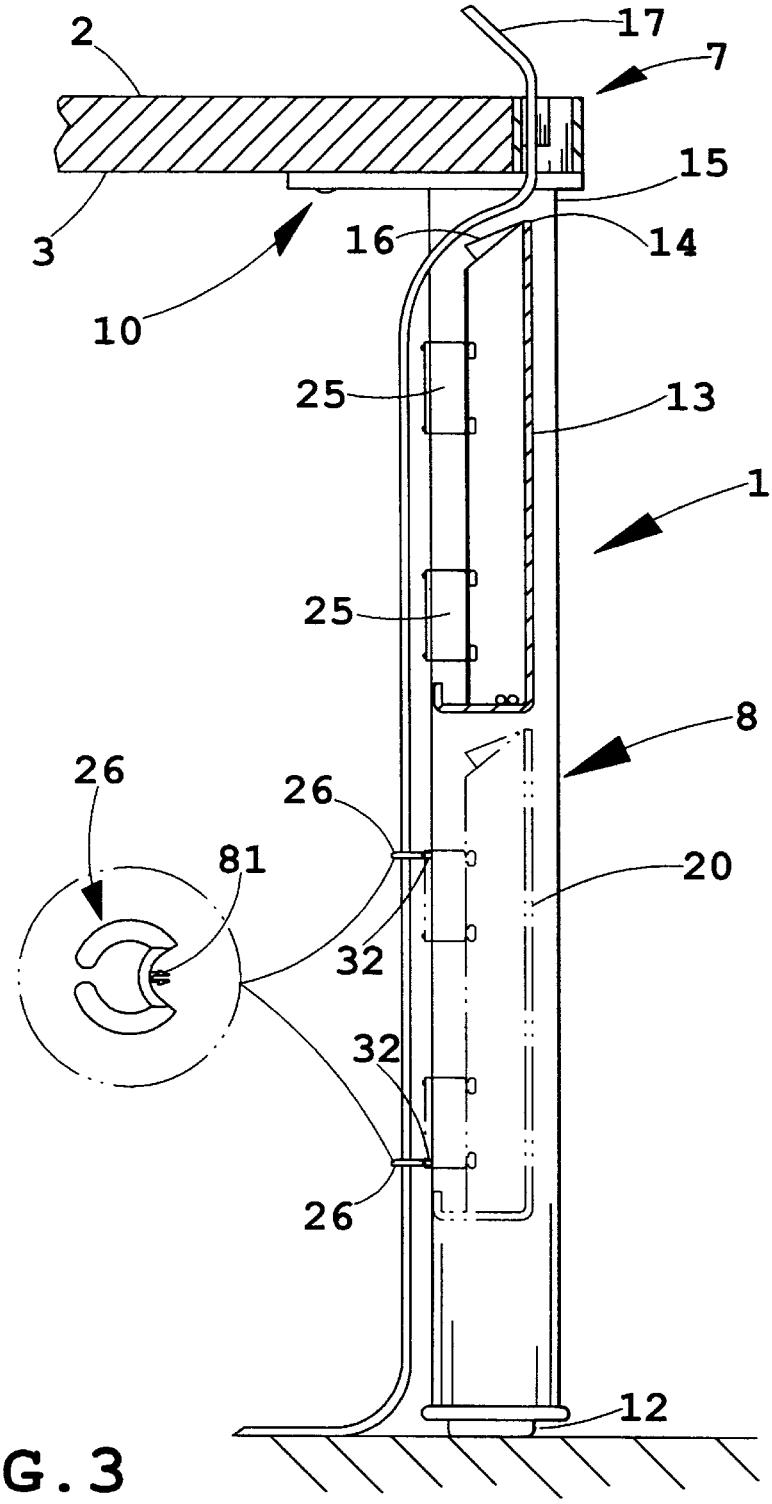
FIG. 3 is a cross-sectional view of the worksurface unit taken along the line III—III, FIG. 2.

The reference numeral 1 (FIG. 1) generally designates a freestanding worksurface unit for offices and the like embodying the present invention. In the illustrated example, freestanding worksurface unit 1 includes a worksurface 2 defining a lower surface 3 (FIG. 3), a front edge 4 (FIG. 1) shaped to be positioned adjacent a seated user, and a rear edge 5 disposed opposite the front edge 4. The rear edge 5 includes a substantially straight portion 6, and a concave cut-out portion 7. At least two legs 8 each have an upper end 10 operably connected with the worksurface 2 adjacent the rear edge 5, and a lower end 12 shaped to support the worksurface on a floor. A panel 13 is connected with and extends between the legs 8, and has an upper edge 14 that is spaced-apart from the lower surface 3 of the worksurface 2 to define a passageway 15 (FIG. 3). The upper edge 14 is sloped downwardly at 16 towards the front edge 4 of the worksurface 2 such that utility lines 17 can be routed through the cut-out portion 7 of the rear edge 5, through the passageway 15, and over the sloped upper edge 14.

Figure 2:
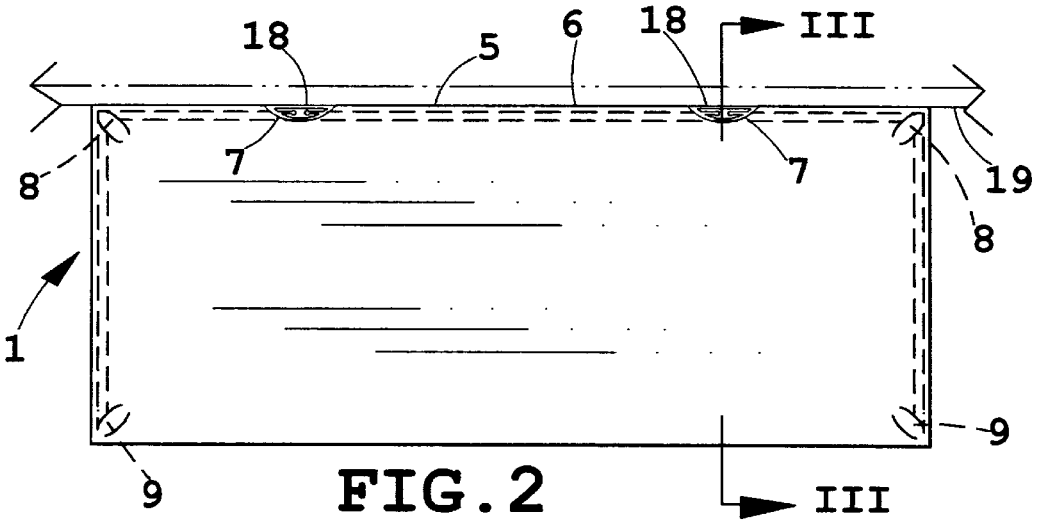
FIG. 2 is a top plan view of the freestanding worksurface unit.

As described in more detail below, each cut-out portion 7 of the rear edge 5 may receive a wire manager 18 that retains power or communication lines, such that the free end of the utility line does not drop to the floor if inadvertently released. As best seen in FIG. 2, the cut-out 7 also allows routing of utility lines when the rear edge 5 of the worksurface unit 1 is placed against an existing architectural wall or partition panel 19. Furthermore, if desired for a particular application, the rear edge 5 may be secured to a panel 19 using brackets. In this configuration the rear legs 8 may be omitted.

As illustrated in FIG. 1, a lower modesty panel 20 may also be connected to the rear legs 8, with upper panel 13 juxtaposed above the lower panel 20. Furthermore, upper and lower end panels 21 and 22 may also be connected between a front leg 9 and a rear leg 8 below a side edge 23 of the worksurface 2. Each modesty panel may include a plurality of horizontally-extending grooves or indentations 11 in the front face 49. Grooves 11 provide a decorative appearance and/or stiffen the modesty panels 13, 20, 21 and 22. As described in more detail below, each of the modesty panels 13, 20, 21 and 22 have substantially the same configuration, such that a single bracket configuration 25 (FIG. 3) can be used to mount each of the panels to the legs.

As described in more detail below, a C-shaped wire retainer 26 (FIG. 3) may be installed to a leg 8 or 9 to retain power or data wires 17 along the leg if a single, upper modesty panel 13 is used, or if neither an upper or lower modesty panel 13, 20 is used.

Figure 4:
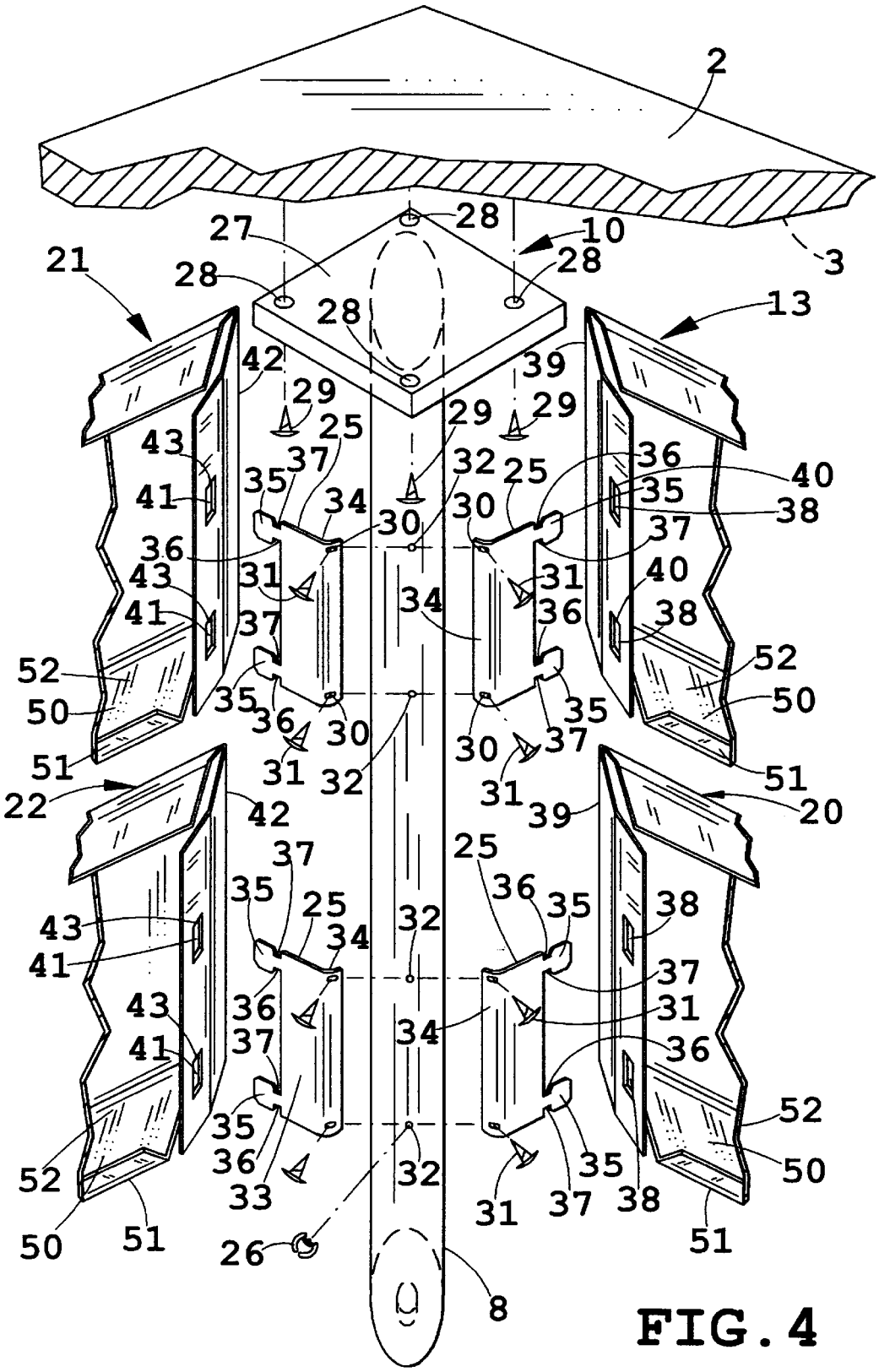
FIG. 4 is a fragmentary, exploded perspective view showing the modesty panels and mounting brackets.

With reference to FIG. 4, each leg 8 or 9 is tubular with an elliptical cross section. A castor 24 may be located at the lower end of either or both legs 8 and 9. Legs 8 and 9 are substantially the same, such that leg 9 will not be described in detail herein. A plate 27 is welded to the upper end 10 of the leg 8, and screws or other fasteners 29 are inserted through clearance holes 28 in the plate 27 to secure the upper end of the leg 8 to the lower surface 3 of the worksurface 2. Each bracket 25 is formed from sheet metal, and includes a clearance holes 30. Legs 8 and 9 each include at least four threaded holes 32 along an inner edge that receive screws or other fasteners 31 to retain the bracket 25 to the leg 8. Each bracket 25 includes a base portion 33 with a curved edge 34 having an inner contour that closely matches the elliptical outer surface of the leg 8. Each bracket 25 further includes two tabs 35 extending from the base 33. Each tab 35 defines opposing slots 36 and 37 that retain the panels 13, 20, 21 or 22 when the tab 35 is inserted into the opening or slot 38 of the modesty panel. When the bracket 25 is used to support a modesty panel 13 or 20 along a first side edge 39, the bracket 25 is oriented such that the slots 36 open upwardly, and engage the upper edge 40 of the first openings 38. However, the bracket 25 can be rotated 180 degrees, such that the tabs extend in an opposite direction wherein the slots 37 open upwardly. The tab can then be inserted into second openings 41 such that the slot 37 engages the upper edge 43 of the second openings 41 along the second edge 42 of a modesty panel 13, 20, 21 or 22. When a leg 8 or 9 is used to mount a pair of modesty panels such as upper panels 13 and 21, the curved edge portions 34 of a pair of brackets 25 are placed in an overlapping position, and a fastener 31 is inserted through both brackets 25 into the threaded hole 32. However, if a single panel is being connected to a leg, such as a rear leg 9, a single bracket 25 is secured to the leg 9 using fasteners 31.

Because the bracket 25 can be rotated 180 degrees, a single bracket configuration 25 can be used as either a left-hand bracket, or a right-hand bracket. Furthermore, because a pair of brackets 25 can be secured to a single leg, with the curved edge portions 34 overlapping, a pair of brackets 25 can be used to secure a pair of modesty panels 13 and 21 to a single leg 8 or 9. As discussed above, if required for a particular application "half-height" upper modesty panels 13 and 21 may be used without lower modesty panels 20 and 22. However, if required for a particular application, lower modesty panels 20 and 22 can also be installed, thereby providing a "full-height" modesty panel. Furthermore, if required for a particular application, the worksurface unit may be used without any modesty panels. When the half-height modesty panels or no modesty panels are used, a C-shaped wire retainer 26 may be inserted into the threaded holes 32 to retain wires along the legs 8 and/or 9.

Figure 5:
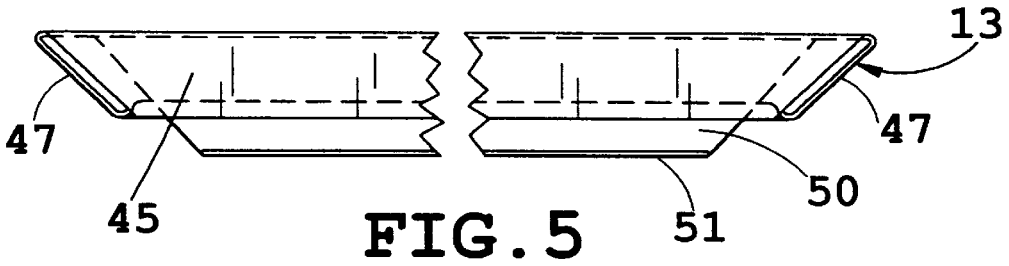
FIG. 5 is a fragmentary, top plan view of the modesty panel.
Figure 6:
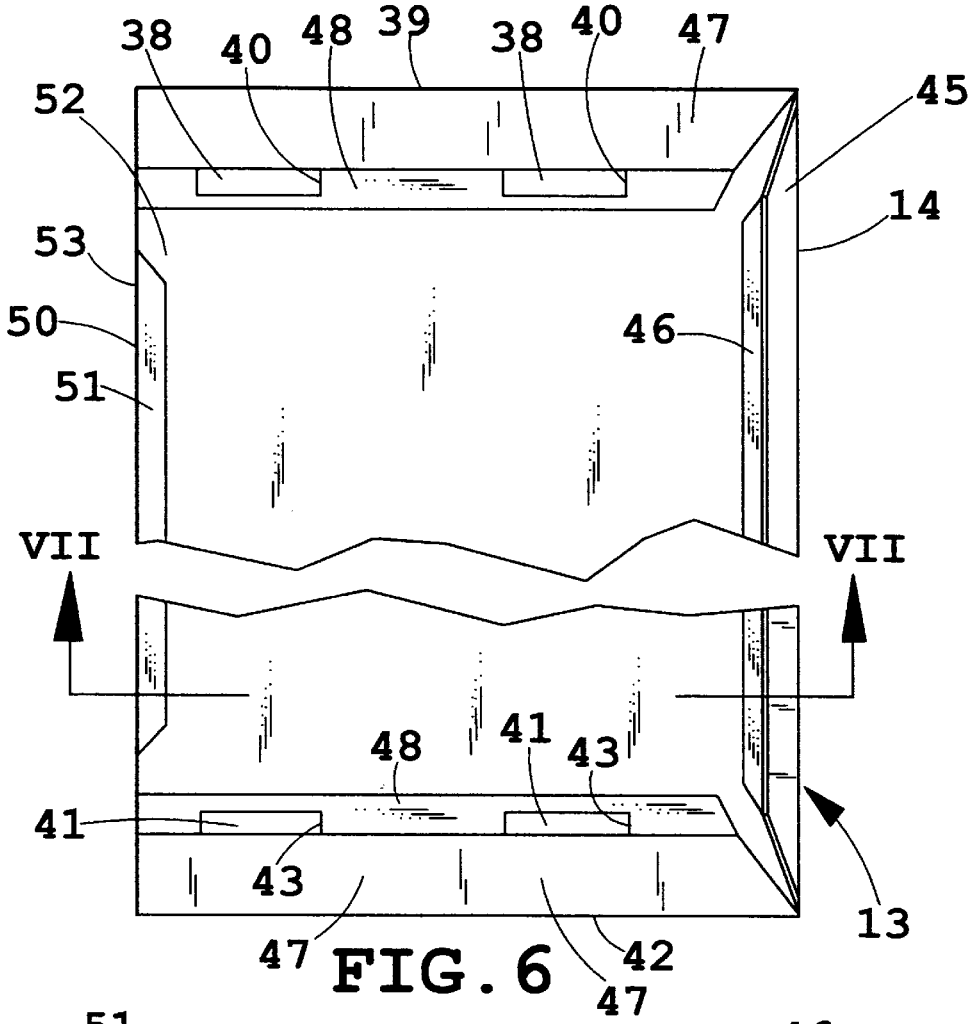
FIG. 6 is a fragmentary, front elevational view of the modesty panel.
Figure 7:
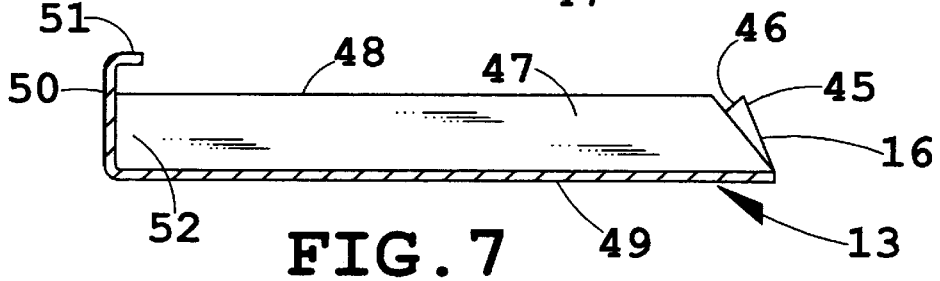
FIG. 7 is a cross-sectional view of the modesty panel taken along the line VII—VII, FIG. 6.

With reference to FIGS. 5–7, each modesty panel is formed from sheet metal, and includes an upper flange 45 that is sloped downwardly at 16 to provide clearance for utility lines 17. Upper flange 45 includes an inwardly bent edge portion 46 that stiffens the flange 45. Side flanges 47 extend inwardly from each of the opposite side edges 39 and 42 of the panel, and include an edge portion 48 that is generally parallel to the front face 49 of the panel 13. First openings 38 are located in the edge portion 48 of the side flange 47 adjacent the first edge 39, and second openings 41 are located in the edge portion 48 of the side flange 47 adjacent the second edge 42 of the panel 13. Panel 13 includes a lower flange 50 that extends orthogonally rearwardly from the front face 49. Flange 50 includes an upwardly-extending edge portion 50, such that a U-shaped raceway or trough 52 is formed along the lower edge 53 of the modesty panel 13. The raceway 52 is shaped to retain power or data lines 17, such that utility lines can be routed horizontally within the worksurface unit.

Figure 8:
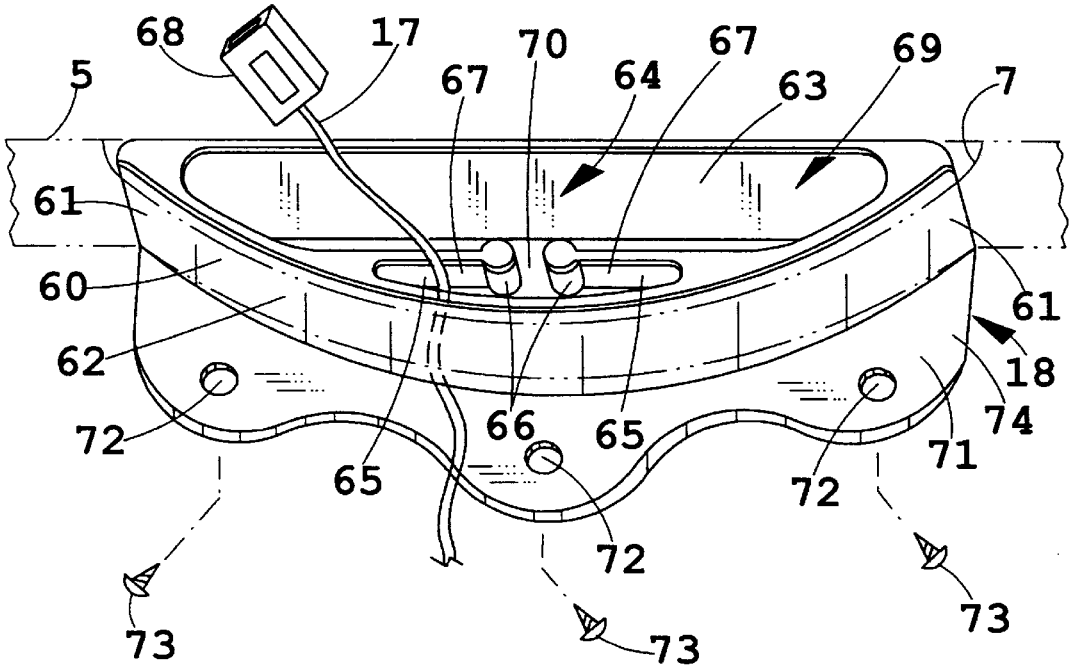
FIG. 8 is a perspective view of the wire manager for mounting in the cut-out of the rear edge of the worksurface.

With reference to FIG. 8, a wire manager 18 may be installed in the cut-out portion 7 of the rear edge 5 of the worksurface 2. Wire manager 18 is made of a polymeric material, and includes a rear wall 60 with opposite ends 61, and an outer surface 62 that closely corresponds to the contour of the concave cut-out portion 7 of the rear edge 5 of the worksurface 2. A substantially straight front wall 63 extends between the opposite ends 61 of the rear wall 60 to define a wire-receiving opening 64 through the wire manager 18. A pair of wire-retaining prongs 65 extend from the rear wall 60 into the opening 64 to retain a free end 68 of a wire 17 above the worksurface 2. Each of the prongs 65 have a cylindrical, larger end portion 66, and define a smaller open area 67 between the prongs 65 and the rear wall 60. A larger open area 69 of the wire-receiving opening 64 is located between the straight front wall 63 and the prongs 65. The larger open area 69 provides extra clearance, such that the plugs or other connectors at the end 68 of the wire 17 can be passed through the wire manager 18. After the wire 17 is passed through the open area 69, the wire 17 is pulled through the gap or opening 70 between the end portions 66 of the prongs 65 and located within the smaller portion 67 of the wire-receiving opening 64. The smaller area 67 retains the end 68 of the wire 17 above the worksurface if released by the user. If desired for a particular application, additional wire-retaining prongs 65 may extend from the rear wall 60 parallel to the prongs 65 illustrated in FIG. 8. This arrangement provides additional wire retaining capability between the parallel sets of prongs 65. A retaining flange 71 extends orthogonally from rear wall 60, and includes a plurality of clearance holes or openings 72. The upper surface 74 of the flange 71 abuts the lower surface 3 of the worksurface 2, and screws or other fasteners 73 pass through the clearance holes 72 and into the lower surface 3 of the worksurface 2 to retain the wire manager 18 to the worksurface 2.

Figure 9:
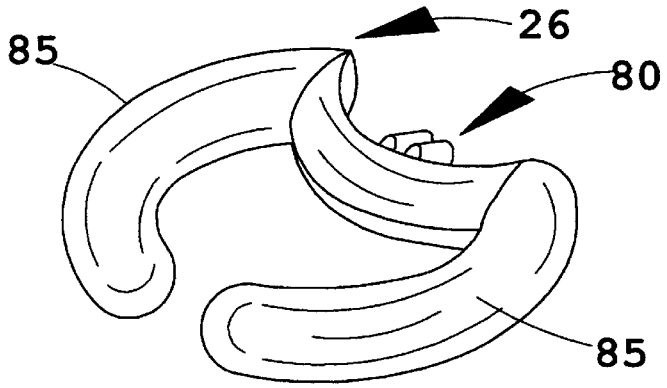
FIG. 9 is a perspective view of a C-shaped wire retainer that snaps into the legs of the freestanding worksurface unit.
Figure 10:
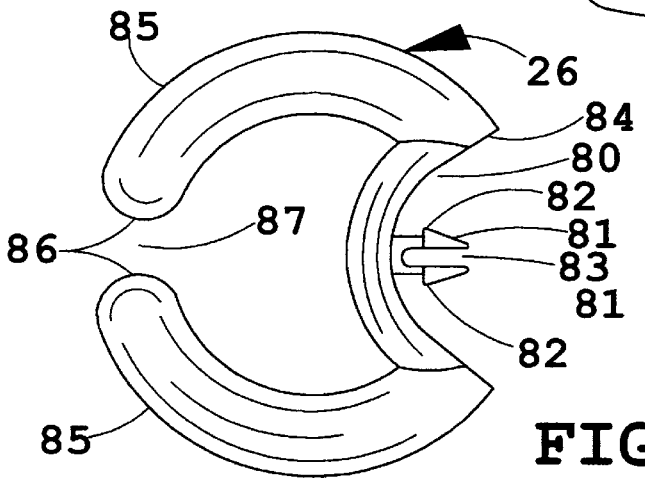
FIG. 10 is a top plan view of the C-shaped wire retainer that snaps into the legs of the freestanding worksurface unit.

With reference to FIGS. 9 and 10, a wire retainer 26 is made of a polymeric material and includes a base portion 80 having a pair of barbed extensions 81 that are inserted into the threaded holes 32 of a leg 8 or 9. If required for a particular application, wire retainer 26 could be secured to holes (not shown) in the worksurface or modesty panels. When installed, the rear edge 82 of each barb 83 abuts the inner surface of the tubular leg, providing a secure connection. The curved inner surface 84 of the base 80 has a shape closely corresponding to the contour of the elliptical outer surface of the leg, such that the base portion 80 of the wire retainer 26 fits snugly against the leg in the installed position. A pair of curved, flexible arms 85 have a generally cylindrical cross-sectional shape, and extend from the base portion 80. The ends 86 of the flexible arms have a spherical shape, and define a gap 87 therebetween. As discussed above, if a single, upper panel 13 is being used with the worksurface unit 1, one or more C-shaped wire retainers 26 may be installed in the lower openings 32 in the leg 8 to retain utility lines 17 along the leg. Furthermore, if no modesty panels are being used with the worksurface unit 1, additional wire retainers 26 may be inserted into the upper holes 32 in the leg 8 as required.

During assembly, the legs 8 and 9 are first secured to the worksurface 2 using screws or other fasteners 29 (FIG. 4). Brackets 25 are then secured to the legs 8 and 9 using fasteners 31. As discussed above, the rear legs 8 may have a pair of brackets 25 installed, with the curved edge portion 34 of the adjacent brackets 25 overlapping. If a full-height modesty panel is being used, lower brackets 25 are also installed to the leg 8 using fasteners 31. Because each bracket 25 is substantially identical, brackets 25 may be oriented as required to support a side edge 39 or 42 of a modesty panel. After the brackets 25 are installed, the modesty panels 13, 20, 21 and 22 are installed by inserting the tabs 35 into the openings 38 and 41 as required. Utility lines 17 may then be routed along the raceways 52 of the modesty panels, through the passageway 15 between the upper edge 14 of the modesty panel 13 and the lower surface 3 of the worksurface 2, and through the cut-out 7 along the rear edge 5 of the worksurface 2. If desired for a particular application, a wire manager 18 is installed in the cut-out 7 using screws or other fasteners 73. The wires 17 may then be routed through the wire manager 18 as described above. If the worksurface unit 1 is being used with only half-height, upper modesty panels 13 and 21, C-shaped wire retainers 26 are installed into the threaded openings 32 of the leg 8 as required, and wires 17 are routed along the legs 8 or 9. If no modesty panels are being used, C-shaped wire retainers 26 may be installed in the upper threaded openings 32 in the legs 8 and/or 9 as required to route the utility lines 17 along the legs.

The freestanding worksurface unit 1 can be used in a variety of configurations, including half or full-height modesty panels. Furthermore, the modesty panels and wire managers 18, as well as the C-shaped wire retainers 26 provide simple and effective wire management capabilities.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A freestanding worksurface unit for offices, comprising:

a worksurface defining a lower surface, a front edge, and a rear edge disposed opposite said front edge, said rear edge including a substantially straight portion, and a concave cut-out portion;

at least two legs, each having an upper end operably connected with said worksurface adjacent said rear edge, and a lower end shaped to support said worksurface on a floor; and a panel connected with and extending between said legs and having an upper edge spaced-apart from said lower surface of said worksurface to define a passageway, said panel upper edge having an upper surface sloped downwardly towards said front edge such that utility lines can be routed through said cut-out portion of said rear edge, through said passageway and over said sloped upper surface.

2. A worksurface unit as set forth in claim 1, wherein:

said panel defines first and second opposite side edges, each side edge releasably connected to a selected one of said legs.

3. A freestanding worksurface unit for offices, comprising:

a worksurface defining a lower surface, a front edge, and a rear edge disposed opposite said front edge, said rear edge including a substantially straight portion, and a concave cut-out portion;

at least two legs, each having an upper end operably connected with said worksurface adjacent said rear edge, and a lower end shaped to support said worksurface on a floor;

a panel connected with and extending between said legs and having an upper edge spaced-apart from said lower surface of said worksurface to define a passageway, said panel upper edge having an upper surface sloped downwardly towards said front edge such that utility lines can be routed through said cut-out portion of said rear edge, through said passageway and over said sloped upper surface, said panel defining first and second opposite side edges, each side edge releasably connected to a selected one of said legs, said panel including inwardly-extending side flanges extending along said side edges, a first side flange including at least one opening defining an upper edge; and a discrete bracket having a base portion removably secured to a selected one of said legs, and including a tab extending from said base portion, said tab defining an upwardly-opening slot, said tab engaging said opening in said side flange to removably retain said panel to said leg.

4. A worksurface unit as set forth in claim 3, wherein:

said panel defines a lower edge having an inwardly-extending lower flange, said lower flange including an upwardly-extending edge portion to define a raceway along said lower edge shaped to receive utility lines therein.

5. A worksurface unit as set forth in claim 4, wherein:

said panel includes an inwardly-extending upper flange along said upper edge defining said downwardly sloped upper surface.

6. A worksurface unit as set forth in claim 5, wherein:

said panel comprises an upper panel; and including:

a lower panel juxtaposed below said upper panel.

7. A worksurface unit as set forth in claim 6, wherein:

said lower panel is substantially identical to said upper panel.

8. A worksurface unit as set forth in claim 7, including:

a wire manager disposed within said concave cut-out portion; said wire manager including:

a rear wall having opposite ends and defining an outer surface closely corresponding to said concave cut-out portion of said rear edge of said worksurface;

a substantially straight front wall extending between said opposite ends of said rear wall to define with said rear wall a wire-receiving opening through said wire manager; and at least one wire-retaining prong extending from said rear wall into said opening to retain a free end of a wire above said worksurface.

9. A worksurface unit as set forth in claim 8, including:

a wire retainer having a C-shape with a base connected to a selected one of said legs and a pair of flexible arms extending therefrom to releasably retain utility lines within said flexible arms along said leg.

10. A freestanding worksurface unit for offices, comprising:

a worksurface defining a rear edge;

at least four elongated legs, each having an upper end secured to said worksurface adjacent said rear edge and a lower end shaped to support said worksurface on a floor;

upper and lower panels, said upper panel juxtaposed above said lower panel, each panel extending between a selected pair of said legs and defining front faces and opposite side edges removably connected to first and second ones of said selected pair of legs, each panel defining a lower edge having a raceway extending therealong for routing utility lines; and at least one bracket having a base portion connected to a selected one of said legs, and a tab extending from said base in a first direction, said tab defining opposing slots, a first one of said slots opening upwardly when said bracket is installed in a first orientation and engaging said upper edge of said opening adjacent said first side edge of said panel, and a second one of said slots opening downwardly when said bracket is installed in the first orientation such that said bracket can be mounted to a selected one of said legs in a second orientation wherein said bracket is oriented in a position wherein said bracket is rotated about a horizontal axis one hundred and eighty degrees from said first orientation with said tab extending opposite said first direction such that said second slot opens upwardly to engage said upper edge of said opening adjacent said first side edge of said panel.

11. A worksurface unit as set forth in claim 10, including:

at least one of said panels includes inwardly-extending side flanges extending along said side edges, a first side flange including at least one opening defining an upper edge; and including:

a bracket having a base portion secured to a selected one of said legs, and including a tab extending from said base portion, said tab defining an upwardly-opening slot, said tab engaging said opening in said side flange to retain said panel to said leg.

12. A worksurface unit as set forth in claim 11, wherein:

said lower edge of each panel includes an inwardly-extending lower flange having an upwardly-extending edge portion.

13. A worksurface unit as set forth in claim 12, wherein:

said upper panel has an inwardly-extending upper flange defining a sloped upper edge of said upper panel.

14. A worksurface unit as set forth in claim 13, wherein:

said rear edge of said worksurface includes a substantially straight portion, and a concave cut-out portion.

15. A worksurface unit as set forth in claim 14, wherein:

each side flange extends at an acute angle relative to said front face of said panel.

16. A worksurface unit as set forth in claim 15, including:

a wire manager disposed within said concave cut-out portion; said wire manager including:

a rear wall having opposite ends and defining an outer surface closely corresponding to said concave cut-out portion of said rear edge of said worksurface;

a substantially straight front wall extending between said opposite ends of said rear wall to define with said rear wall a wire-receiving opening through said wire manager; and at least one wire-retaining prong extending from said rear wall into said opening to retain a free end of a wire above said worksurface.

17. A worksurface unit as set forth in claim 16, including:

a wire retainer having a C-shape with a base connected to a selected one of said legs and a pair of flexible arms extending therefrom to releasably retain utility lines within said flexible arms along said leg.

18. A worksurface unit as set forth in claim 17, wherein:

said legs define a sidewall with at least one opening therethrough;

said base of said wire retainer including a flexible barbed extension received within said opening to secure said wire retainer to said leg.

19. A freestanding worksurface unit for offices, comprising:

a worksurface defining a rear edge;

at least two legs, each having an upper end secured to said worksurface adjacent said rear edge;

a panel extending between said legs and defining first and second side edges adjacent said legs and including an opening adjacent each side edge, each opening having an upper edge; and at least one discrete bracket mountable in first and second orientations and having a base portion connected to a selected one of said legs, and a tab extending from said base in a first direction when said bracket is installed in the first orientation, said tab defining opposing slots, a first one of said slots opening upwardly and engaging said upper edge of said opening adjacent said first side edge of said panel when said bracket is in the first orientation, and a second one of said slots opening downwardly when said bracket is in the first orientation such that said bracket can be mounted to a selected one of said legs in a second orientation with said tab oriented such that said second slot opens upwardly to engage said upper edge of said opening adjacent said first side edge of said panel, thereby permitting use of said bracket in both first and second orientations which are rotated one hundred and eighty degrees with respect to one another.

20. A worksurface unit as set forth in claim 19, wherein:

said panel includes an inwardly-projecting side flange extending along each side edge, each side flange having an opening therein engaging said tab.

21. A worksurface unit as set forth in claim 20, wherein:

said opening comprises an upper opening, and said side flange includes a lower opening having an upper edge;

said bracket includes a second tab extending in said first direction and defining opposing slots, a first one of said slots opening upwardly and engaging said upper edge of said lower opening when said bracket is in the first orientation, a second slot opening downwardly such that said bracket can be mounted to a selected one of said legs in a second orientation with said tab oriented such that said second slot opens upwardly to engage said upper edge of said lower opening.

22. A worksurface unit as set forth in claim 21, wherein:

said panel defines a lower edge having an inwardly-extending lower flange, said lower flange including an upwardly-extending edge portion to define a raceway along said lower edge shaped to receive utility lines therein.

23. A worksurface unit as set forth in claim 22, wherein:

said panel includes an inwardly-extending upper flange along said upper edge defining a downwardly sloped upper edge.

24. A worksurface unit as set forth in claim 23, wherein:

said rear edge of said worksurface includes a substantially straight portion and a concave cut-out portion.

25. A worksurface unit as set forth in claim 24, wherein:

a wire manager disposed within said concave cut-out portion; said wire manager including:

a rear wall having opposite ends and defining an outer surface closely corresponding to said concave cut-out portion of said rear edge of said worksurface;

a substantially straight front wall extending between said opposite ends of said rear wall to define with said rear wall a wire-receiving opening through said wire manager; and at least one wire-retaining prong extending from said rear wall into said opening to retain a free end of a wire above said worksurface.

26. A worksurface unit as set forth in claim 25, wherein:

said panel comprises an upper panel; and including:

a lower panel juxtaposed below said upper panel.

27. A worksurface unit as set forth in claim 26, wherein:

said lower panel is substantially identical to said upper panel.

28. A worksurface unit as set forth in claim 27, wherein:

said bracket and said panels are formed from sheet metal.

29. A worksurface unit for offices, comprising:

a worksurface defining a front edge and a rear edge;

at least two legs, each having an upper end secured to said worksurface, and a lower end shaped to support said worksurface on a floor; and a wire retainer having a C-shape with a base portion connected to said worksurface unit, said wire retainer having a pair of substantially identical flexible arms extending therefrom to releasably retain utility lines within said flexible arms along said leg.

30. A worksurface unit for offices, comprising:

a worksurface defining a front edge and a rear edge; said legs each defining a sidewall with at least one opening;

at least two legs, each having an upper end secured to said worksurface, and a lower end shaped to support said worksurface on a floor, a wire retainer having a C-shape with a base portion connected to said worksurface unit, said wire retainer having a pair of substantially identical flexible arms extending therefrom to releasably retain utility lines within said flexible arms along said leg;

said base portion of said wire retainer including a pair of flexible barbed extensions received within said opening and securing said wire retainer to said leg each said flexible arms defining a free end, said free ends spaced-apart to define a gap therebetween when in an unflexed condition, such that said flexible arms return to said unflexed condition upon insertion of utility lines within said flexible arms.

31. A worksurface unit as set forth in claim 30, including:

a panel extending between said legs.

32. A worksurface unit as set forth in claim 31, wherein:

said legs have a curved outer surface; and said base portion of said wire retainer has a curved surface closely corresponding to said curved outer surface of said legs.

33. A worksurface unit as set forth in claim 32, wherein:

said rear edge of said worksurface includes a substantially straight portion, and a concave cut-out portion.

34. A wire manager for worksurfaces, comprising:

a rear wall having opposite ends and defining an outer surface closely corresponding to a concave cut-out portion of an edge of a worksurface;

a substantially straight front wall extending between said opposite ends of said rear wall to define with said rear wall a wire-receiving opening; and at least one wire-retaining prong extending from said rear wall into said opening and dividing said wire-receiving opening into a relatively large portion having sufficient size to permit passing of a conventional plug connector therethrough, and into a wire-retaining portion that is smaller than said relatively large portion to prevent passage of a conventional plug connector therethrough and thereby retain a free end of a wire above a worksurface.

35. A wire manager as set forth in claim 34, wherein:

said wire-retaining prong is flexible to permit manual installation of wires between said prong and a selected one of said front and rear walls.

36. A wire manager as set forth in claim 35, wherein:

said wire-retaining prong is integrally formed with said rear walls and extends parallel to said front wall.

37. A wire manager as set forth in claim 36, wherein:

said prong comprises a first prong having an end; and including:

a second wire-retaining prong fixedly secured to said rear wall and extending from said rear wall and having an end that is spaced-apart from said end of said first prong to define a gap therebetween such that wires can be pulled through said gap and retained between said prongs and said rear wall.

38. A wire manager as set forth in claim 37, including:

an orthogonal mounting flange extending from said rear wall.

39. A kit for freestanding worksurface units, comprising:

a worksurface defining a front edge shaped to be positioned adjacent a seated user and a rear edge;

at least two legs adapted to be secured to said worksurface adjacent said rear edge, each leg including an upper connector and a lower connector; and a panel defining first and second opposite side edges, each side edge adapted to interconnect with said upper and lower connectors of said legs such that said panel can be selectively mounted in an upper position on said upper connectors, and a lower position on said lower connectors; and a bracket having a base portion adapted to mount to said upper and lower portions of said legs, said bracket including a connector extending from said base portion, said connector adapted to secure said first side edge of said panel to said leg when said bracket is mounted to said leg in a first orientation, and also adapted to secure said second side edge of said panel to said leg when said bracket is mounted to said leg in a second orientation.

40. A kit for freestanding worksurface units as set forth in claim 39, wherein:

said panel has an upper edge that slopes downwardly towards said front edge when said panel is mounted to said legs.

41. A kit for freestanding worksurface units as set forth in claim 40, wherein:

said rear edge of said worksurface includes a substantially straight portion, and a concave cut-out portion.

42. A kit for freestanding worksurface units as set forth in claim 41, including:

a second panel defining first and second opposite side edges, each side edge adapted to interconnect with said upper and lower connectors of said legs such that said panel can be selectively mounted in an upper position on said upper connectors, or in a lower position on said lower connectors of said legs.

43. A kit for freestanding worksurface units as set forth in claim 42, including:

a wire manager adapted to be mounted within said cut-out portion of said rear edge, said wire manager defining an opening therethrough, and at least one wire-retaining prong extending from said rear wall into said opening to retain a free end of a wire above said worksurface.

* * * * *